United States Patent [19]

Heiland

[11] 4,360,803

[45] Nov. 23, 1982

[54] DOOR LOCK ASSEMBLY WITH ELECTRICAL ALARM

[75] Inventor: Bernd Heiland, Telgte, Fed. Rep. of Germany

[73] Assignee: Aug. Winkhaus, Telgte, Fed. Rep. of Germany

[21] Appl. No.: 45,846

[22] Filed: Jun. 5, 1979

[30] Foreign Application Priority Data

Jun. 13, 1978 [DE] Fed. Rep. of Germany ... 7817702[U]

[51] Int. Cl.[3] ..... G08B 13/06

[52] U.S. Cl. ..... 340/542; 340/665

[58] Field of Search ..... 340/542, 665, 545

[56] References Cited

U.S. PATENT DOCUMENTS

| | | | |
|---|---|---|---|
| 2,660,632 | 11/1953 | Makishima | 340/542 |
| 3,587,080 | 6/1971 | Hawkins | 340/542 |
| 3,604,958 | 9/1971 | Palini | 340/545 |
| 4,176,347 | 11/1979 | McIntyre | 340/545 |

FOREIGN PATENT DOCUMENTS

| | | |
|---|---|---|
| 2030867 | 11/1973 | Fed. Rep. of Germany . |
| 2436778 | 3/1975 | Fed. Rep. of Germany . |
| 2706210 | 6/1978 | Fed. Rep. of Germany . |
| 1351046 | 4/1974 | United Kingdom . |
| 1378633 | 12/1974 | United Kingdom . |

*Primary Examiner*—Glen R. Swann, III

*Attorney, Agent, or Firm*—Toren, McGeady & Stanger

[57] ABSTRACT

A door lock assembly having an electrical alarm system includes a piezoelectric element located between the lock bolt of the door lock and the lock frame in order to emit a signal to energize the electrical alarm system when pressure is applied between the lock bolt and the frame.

15 Claims, 3 Drawing Figures

DOOR LOCK ASSEMBLY WITH ELECTRICAL ALARM

BACKGROUND OF THE INVENTION

The present invention relates generally to security alarm systems and more particularly to a door lock assembly, particularly a mortise lock, including an electrical alarm system. More specifically, the invention involves a lock assembly which includes a lock frame and a lock bolt which may be moved out of the lock frame into locking position. An electrical alarm system is actuated by an alarm element formed as part of the lock assembly which energizes the alarm system to produce a signal when pressure is applied upon the lock bolt of the assembly.

A door lock assembly of the type to which the present invention relates is known from German Auslegeschrift 20 30 867 wherein an alarm element is constructed as a switch contact which transmits an electrical voltage and which is connected to the input of an alarm system spatially separated from the door itself. The switch contact is actuated by a guide sleeve of the lock bolt of the system which is pivoted transversely relative to the door together with the lock bolt when a tractive or compressive force is applied to the door. However, due to the relatively long distance through which the switch contact must move in order to release the alarm, the lock bolt of this known door lock alarm system must be guided in the lock frame with a relatively large degree of play. This results in that the door cannot be closed with a snug fit. Moreover, the pivotal support of the lock bolt in the lock frame requires additional measures and it is therefore not possible to equip door locks of any selected type with the alarm element.

The present invention is directed toward providing a system wherein door locks may be equipped with an alarm element without requiring changes in the design of the lock bolt guide, with the alarm element of the invention responding to the opening of the door when the lock bolt is moved out of the locking position.

SUMMARY OF THE INVENTION

Briefly, the present invention may be described as a door lock assembly for a door comprising a lock frame, a lock bolt which is moved to locking position with said lock frame, and electrical alarm means responsive to pressure on said lock bolt for generating an alarm signal, and electrical alarm means comprising a piezoelectric element arranged between said lock bolt and said lock frame in the region of the locking end of said lock bolt on the side of said lock bolt which is located in the locking direction of said door.

Thus, the present invention provides an improvement over the prior art in that the alarm element is constructed as a piezoelectric element and is arranged between the lock bolt and the lock frame in the region of the locking end of the lock on that side of the lock bolt which is located in the locking direction of the door.

The piezoelectric element detects compressive forces which act between the lock bolt and the lock frame. The switching movements of the lock bolt to be performed in this connection transversely relative to the door are negligibly small so that it is not necessary to provide additional play between the lock bolt and the lock frame. Particularly, it does not become necessary to change the guiding of the lock bolt in order to facilitate relatively large switching movements of the lock bolt, in the same manner as they are necessary in the aforementioned prior art alarm parts which are constructed as switch contacts. The piezoelectric element generates an electric voltage only when a pressure is applied between its connections, and since it is otherwise without voltage, it is not possible by means of measuring instruments which may measure electric fields, to recognize that the door lock is secured by an alarm.

The piezoelectric element may be supported either at the lock frame or at the lock bolt. The fastening to the lock has the advantage that no movable lines to the piezoelectric element must be provided. If the piezoelectric element is supported at the lock bolt, it is preferable to mount it at a location on the side surface of the lock bolt which is in the region of the edge plate of the lock when the lock bolt is in its locking position. Play of the guide for the lock bolt is smallest in the region of the edge plate whereby maximum safety and enhanced reliability for triggering the alarm system may be obtained.

In accordance with a preferred embodiment of the invention, the piezoelectric element is formed in the shape of a disc and it is arranged in a recess of the lock bolt which is adjusted to the piezoelectric element thereby insuring a simple assembly.

Moreover, the piezoelectric element constructed as a disc will rest with only one of its side faces against the lock bolt so as to establish good electrical conductivity and a good connection. On its other side face, the piezoelectric crystal has a contact plate for an electrical connection with the contact plate being covered by an insulating layer of an electrically nonconductive material.

In this case, the contact plate may be connected by means of a cable to the input of the alarm system. It is preferable for the lock bolt to have a groove which is particularly arranged at the bottom side of the head of the bolt and in which there is arranged a contact path for a sliding contact. The contact path is connected to the contact plate and is electrically insulated against the lock bolt. The sliding contact is preferably fastened to an insulating block of an electrically nonconductive material which may be arranged on the inner side of the edge plate. The voltage which is generated is picked up between the sliding contact and the lock frame which is connected to the lock bolt and it is supplied to the alarm system through an electrical connection.

The piezoelectric element which is constructed in the form of a disc is preferably arranged at the broad side of the bolt head or at a part of the lock frame which is located opposite this broad side. The arrangement is such that the insulating layer projects to a small extent from the broad side of the lock head or from this part of the lock frame so that a mechanically compressive force can be transmitted to the piezoelectric element.

If the piezoelectric element is arranged in the bolt head, it must be moved through the edge plate when the lock bolt is moved into the locking position. As a result, the insulating layer for the piezoelectric element may be damaged. Therefore, the broad side of the bolt head from which the insulating layer projects is preferably covered by a cover plate which is movable in the region of the piezoelectric element transversely relative to the broad side of the bolt head. The cover plate may be mounted, for example, along one of its edges at the bolt head and it may otherwise merely rest against the broad side. In a particularly simple embodiment, there is provided in the broad side transversely relative to the locking direction of the lock bolt a groove which is engaged by a bent edge of the cover plate. At least those portions of the broad side which are located at the end face of the bolt head outside of the cover plate should be essentially flush with the cover plate in order to prevent the bolt head from being caught in the oppositely located locking plate of the door frame. Since the cover plate is impervious to light, even when the lock bolt is in the locking position it will not be possible to determine that an alarm lock is provided.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF PREFERRED EMBODIMENTS

Figure 2:
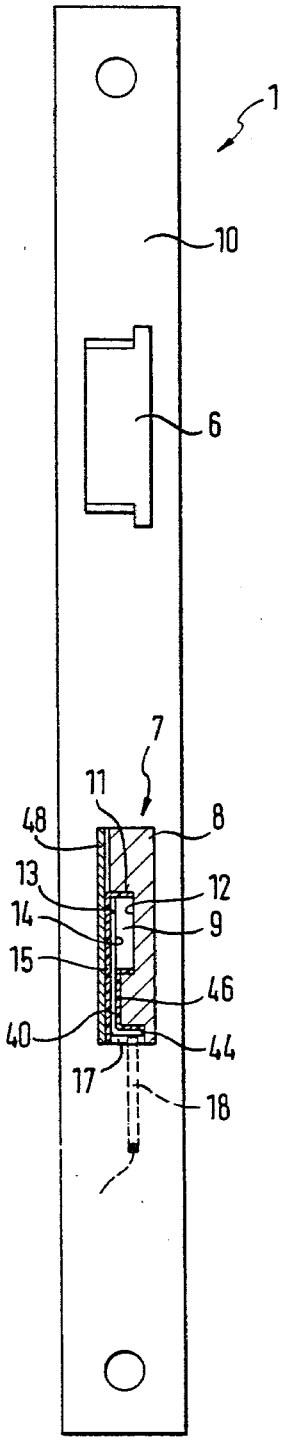
FIG. 2 is a front view of the door lock according to FIG. 1.
Figure 1:
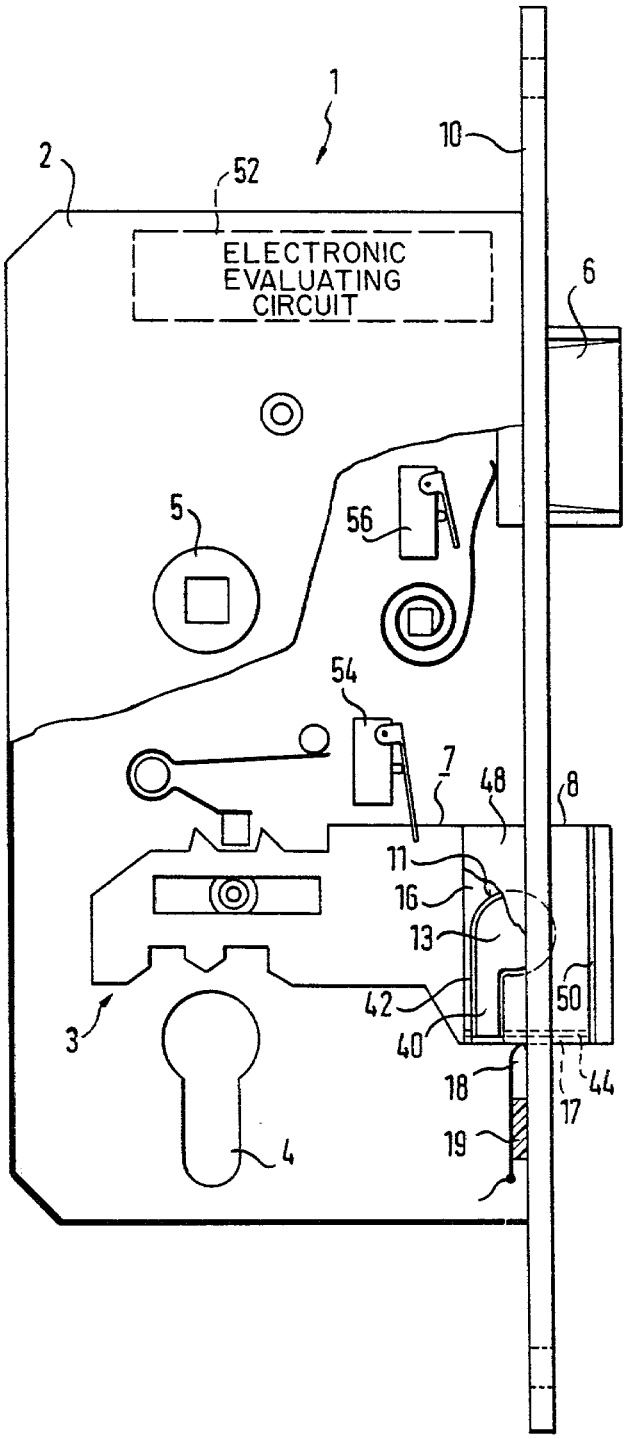
FIG. 1 is a schematic side view of a first embodiment of a door lock assembly in accordance with the invention.

Referring now to FIGS. 1 and 2 wherein a first embodiment of the present invention is depicted, there is shown an overall door lock assembly which is identified by the reference numeral 1. The lock assembly 1 has a frame 2 with a locking mechanism 3 which is arranged in the frame 2.

A hole 4 for inserting a key is provided in the frame 2 and a hole 5 for inserting a door handle by means of which a door latch 6 may be actuated is also provided.

Beneath the door latch 6 there is arranged an overall lock bolt member 7 having a bolt head 8 with a broad side 16. Laterally arranged at the broad side 16 of the bolt head 8 is an alarm element in the form of a piezoelectric element 9 located in such a manner that it is arranged in the region of an edge plate 10 when the lock bolt 7 is in its locking position.

The piezoelectric element is constructed in the shape of a disc and it is arranged within a circular recess 11 formed in the broad side 16 of the bolt head 8, the element 9 being arranged in such a manner that it has one end face 12 resting against the lock bolt 7 to establish good electrical conductivity therewith. Resting against the opposite side or end face of the piezoelectric element 9 is a contact plate 13 which is formed by etching, punching or the like. The contact plate 13 is connected in a single unit with a flag 40 which extends within a groove 42 formed in the broad side 16 of the bolt head 8 extending toward the bottom side of the bolt head 8.

Extending at the bottom side of the bolt head 8 is a groove 17 within which there is arranged a contact element or path 44. The contact path 44 is connected in a single piece to the flag 40 or it is bent out of the plane of the flag 40 located in the broad side 16. An insulating layer 15 covers the contact plate 13 and the flag 40. Moreover, the flag 40 and the contact path 44 are insulated from the bolt head 8 by an insulating layer 46. Additionally, the insulating layer 15 extends around the piezoelectric element 9 into the recess 11 in order to also insulate the outer surface of the element from the bolt head 8.

The insulating layer 15 may protrude slightly, for example to about 0.2 mm, from the broad side 16 of the bolt head 8 in order to enable it to transmit the pressure to the piezoelectric element 9. On the other hand, if the insulating layer is flush with the broad side 16, there must be provided in the edge plate or in the cover plate 48 a raised portion (not shown) which will transmit pressure to the piezoelectric element 9 when the bolt head 8 is in the locking position.

The groove 17 is resiliently engaged by a sliding contact 18 which is arranged on an insulating block 19 at the inside of the edge plate 10. However, the insulating block 19 may just as well be arranged at one of the side walls of the frame. The broad side 16 of the bolt head 8 is covered by a cover plate 48 which extends flush with the upper and lower narrow sides. The cover plate 48 terminates flush with the upper and lower narrow sides of the bolt head 8 and the front edge of the cover plate 48, as seen in the locking direction, is bent (in a manner not shown) and engages a groove 50 of the bolt head 8 which extends parallel to the edge plate 10. The cover plate 48 otherwise rests in a freely movable manner on the broad side 16 so that it is able to transmit pressure on the edge plate 10 to the piezoelectric element 9. The region which is located at the end face of the bolt head 8 outside of the cover plate 48 will be flush with the outer surface of the cover plate 48.

An electronic evaluating circuit 52, which may be constructed for example in the form of a flexible printed circuit, is connected to the piezoelectric element 9 through the frame 2 and the sliding contact 18. The electronic circuit 52 comprises a threshold stage and a pulse generator and it will deliver a defined pulse to an alarm system (not shown) when the voltage delivered by the piezoelectric element 9 exceeds an adjustable threshold value.

In order to detect opening of the door lock in an orderly manner, two microswitches 54 and 56 are connected in series to the alarm system and they are arranged at the frame 2. The microswitches 54, 56 will respond to pulling back of the lock bolt 7 and the lock latch 6.

Figure 3:
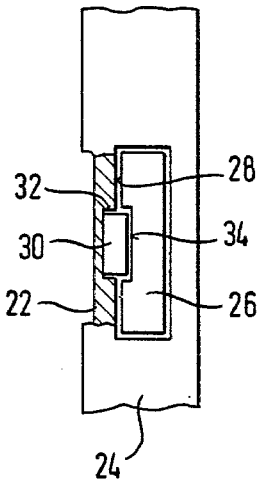
FIG. 3 is a partial sectional view of an end face of a second embodiment of a door lock in accordance with the invention.

FIG. 3 shows a further embodiment of a mortise lock with a frame 22 and an edge plate 24 through which a lock bolt 26 may be moved into its locking position. Between the frame 22 and an adjacently located broad side 28 of the lock bolt 26 there is again arranged a pieoelectric element 30 which responds to pressure applied to the lock bolt 26. Unlike the embodiment previously described herein, the piezoelectric element in the embodiment of FIG. 3 is arranged in a recess 32 of the frame 22.

The shape and the manner of contact of the piezoelectric element 30 corresponds to those of the piezoelectric element 9. However, no sliding contacts are required and the piezoelectric element 30 projects beyond the surface of the lock frame 22 toward the broad side 28 of the lock bolt 26. If the wall thickness of the frame 22 is insufficient to essentially completely receive the piezoelectric element 30, a groove 34 may be worked or formed into the broad side 28 of the lock bolt 26, the groove 34 extending in the locking direction of the lock bolt 26.

While specific embodiments of the invention have been shown and described in detail to illustrate the application of the inventive principles, it will be understood that the invention may be embodied otherwise without departing from such principles.

What is claimed is:

1. A door lock assembly for a door comprising: a lock frame; a lock bolt which is movable into locking position with said lock frame; and electrical alarm means responsive to pressure on said lock bolt for generating an alarm signal; said electrical alarm means comprising a piezoelectric element arranged between said lock bolt and said lock frame in the region of the locking end of said lock bolt on the side thereof which is located in the direction of movement toward said locking position.

2. An assembly according to claim 1 including an edge plate, said piezoelectric element being supported by said lock frame in the region of said edge plate.

3. An assembly according to claim 1 including an edge plate, wherein said piezoelectric element is arranged on a side of said lock bolt at a location which is in the region of said edge plate of said assembly when said lock bolt is in the locking position.

4. An assembly according to claim 1 wherein said piezoelectric element is constructed in the form of a disc and is arranged in a recess defined in one of said lock bolt and said lock frame, said recess being configured to generally conform to the form of said piezoelectric element.

5. An assembly according to claim 4 wherein said piezoelectric element is arranged to rest in electrically conductive relationship against said one of said lock bolt and said lock frame with only one side face thereof, with the other side face of said piezoelectric element having an electrically conductive contact plate, said piezoelectric element being covered on its outer edges by an insulating layer of electrically nonconductive material.

6. An assembly according to claim 5 wherein said lock bolt includes a groove and a contact path, said contact path being arranged in said groove, and also being electrically insulated from said lock bolt and connected with said contact plate.

7. An assembly according to claim 6 wherein said contact plate is connected as a unitary member to said contact path arranged in said groove.

8. An assembly according to claim 6 wherein said groove is arranged on a bottom side of said lock bolt.

9. An assembly according to claim 6 further including a sliding contact maintained in electrical connection with said contact path, said sliding contact being fastened to an insulating block of electrically nonconductive material.

10. An assembly according to claim 9 including an edge plate wherein said insulating block is arranged on the inside of said edge plate.

11. A door lock according to claim 5 wherein said insulating layer covering said piezoelectric element terminates flush with the one of a surface of said lock frame facing toward said lock bolt and a broad side of a bolt head of said lock bolt in which said piezoelectric element rests, and wherein a portion raised toward said piezoelectric element is provided in an opposing surface of one of said bolt head, said lock frame and said edge plate.

12. An assembly according to claim 5 wherein said piezoelectric element is arranged at one of a broad side of a bolt head of said lock bolt and a part of said lock frame which is located opposite said broad side, said insulating layer protruding out of said one of said broad side of said bolt head and said part of said lock frame.

13. An assembly according to claim 12 wherein said broad side of said bolt head from which said insulating layer projects is covered by a cover plate which is capable of being moved transversely relative to said broad side in the region of said piezoelectric element.

14. An assembly according to claim 13 wherein said broad side of said bolt head has a groove extending therein transversely to the locking direction of said lock bolt, said groove being engaged by a bent edge of said cover plate, and wherein those regions of said broad side of said bolt head which are located at the end face of said bolt head lying outside of the area of said cover plate extended essentially flush with said cover plate.

15. An assembly according to claim 14 further including electronic circuit means including means defining a threshold stage connected with said piezoelectric element and arranged at said frame.

* * * * *